US006196303B1

(12) United States Patent
Hepper

(10) Patent No.: US 6,196,303 B1
(45) Date of Patent: Mar. 6, 2001

(54) FANCOIL ASSEMBLIES

(75) Inventor: Jonathan Ivan Hepper, Petersfield (GB)

(73) Assignee: Smiths Industries Public Ltd. Co., London (GB)

( * ) Notice: Subject to any disclaimer, the term of this patent is extended or adjusted under 35 U.S.C. 154(b) by 0 days.

(21) Appl. No.: 09/431,309

(22) Filed: Nov. 2, 1999

(30) Foreign Application Priority Data

Nov. 28, 1998 (GB) ..... 9826047

(51) Int. Cl.[7] ..... F24H 3/06

(52) U.S. Cl. ..... 165/122; 165/111; 165/113; 62/285

(58) Field of Search ..... 165/111, 113, 165/122; 62/285, 298, 288, 291

(56) References Cited

U.S. PATENT DOCUMENTS

| | | | | |
|---|---|---|---|---|
| 4,416,327 | * | 11/1983 | Nakada et al. | 165/122 |
| 4,458,502 | * | 7/1984 | Adachi et al. | 62/285 |
| 5,090,476 | * | 2/1992 | Immel | 165/122 |
| 5,373,894 | * | 12/1994 | Tomatsuri | 165/122 |
| 5,388,426 | * | 2/1995 | Wada et al. | 165/122 |
| 5,481,886 | * | 1/1996 | Hasegawa et al. | 62/285 |
| 5,613,554 | * | 3/1997 | Bull et al. | 165/122 |
| 5,664,430 | | 9/1997 | Karman . | |
| 5,979,171 | * | 11/1999 | Mitchell et al. | 62/288 |
| 6,065,531 | * | 5/2000 | Schneider et al. | 165/122 |
| 6,070,424 | * | 6/2000 | Bauman et al. | 62/285 |

FOREIGN PATENT DOCUMENTS

| | | |
|---|---|---|
| 2 270 152 | 3/1994 | (GB) . |
| 2 302 937 | 2/1997 | (GB) . |

* cited by examiner

*Primary Examiner*—Ira S. Lazarus
*Assistant Examiner*—Terrell McKinnon
(74) *Attorney, Agent, or Firm*—Pollock, Vande, Sande & Amernick, RLLP

(57) ABSTRACT

A heat exchange assembly has a heat exchanger, a fan at one side and a drain tray assembly extending beneath the heat exchanger. The heat exchanger has a pipe along which heated or cooled water is supplied, and a stack of vertical, parallel plates between which the fan passes air. The drain tray assembly has a tray with a peripheral wall and a drain outlet at one end. An inverted gutter fits loosely within the tray spaced from its edges by two channels. The height of the gutter is such as to block the space between the upper surface of the tray and the underside of the heat exchanger so as to prevent air flow beneath the heat exchanger.

10 Claims, 3 Drawing Sheets

30
43,44
53
36
51
52
58
55
35
41,42
III
III
54
50
43
38
44
37
41
42
56
57
59
62
61

FANCOIL ASSEMBLIES

BACKGROUND OF THE INVENTION

This invention relates to fancoil assemblies.

Fancoil assemblies have a heat exchange unit through which air is blown or sucked by means of a fan. The heat exchange unit takes the form of a finned, coiled pipe through which a fluid, such as water, is pumped. When the assembly is used to provide heating, the fluid supplied to the coil is heated; when cooling is required, the fluid is cooled. Typically, the heat exchange unit is of rectangular shape and section, and is arranged such that air flows through the exchange unit at right angles to its length and perpendicularly to its largest face. The heat exchange unit is mounted in an outer casing, which acts to channel air to and from the exchange unit. Preferably, the arrangement of the exchange unit in the casing is such that the maximum amount of air entering the casing flows through the heat exchange unit and the minimum amount flows around it. The heat exchange unit usually sits above a drain tray so that condensation is collected and channelled out of the casing through a suitable conduit for discharge.

The drain tray provides a space below the heat exchange unit into which condensate can flow. In conventional assemblies, this space can also provide a path for air flow under the heat exchange unit, leading to several potential problems. Firstly, the overall efficiency of heat transfer to or from air flowing through the fancoil assembly is reduced because a proportion of the air can by-pass the heat exchange unit. Secondly, the lower resistance to air flow under the heat exchange unit leads to a high velocity compared with air flowing through the exchange unit. This high velocity air flow can blow collected water out of the drain tray leading to leakage problems. The flow of air under the heat exchange unit can also create an elevated pressure below the heat exchange unit that reduces the rate of drainage of condensate from the heat exchange unit into the drain tray. This can cause an accumulation of water within the heat exchange unit, leading to inefficiency in heat transfer. The water accumulated in the heat exchange unit may also be blown out by air flowing through it.

BRIEF SUMMARY OF THE INVENTION

It is an object of the present invention to provide an alternative fancoil assembly.

According to one aspect of the present invention there is provided a fancoil assembly comprising a heat exchange unit, a fan arranged to cause flow of air through the heat exchange unit, and a drain tray assembly below the heat exchange unit to collect liquid from the heat exchange unit, the drain tray assembly including a tray with a peripheral wall, the upper surface of the tray being spaced from the lower surface of the heat exchange unit, the drain tray assembly including a barrier having at least one wall generally opposed to flow of air through the fancoil assembly and spanning the space between the upper surface of the tray and the lower surface of the heat exchange unit such as to restrict flow of air through the space under the heat exchange unit, and the barrier being arranged such that liquid flowing from the heat exchange unit can drain freely into the tray.

The barrier is preferably provided by an inverted gutter having a roof and two walls extending along opposite sides, the walls of the gutter preferably being spaced from opposite sides of the tray to form two channels. The gutter may be a loose fit within the tray. A wall of the gutter on the low pressure side of the assembly preferably has an opening so that the void within the gutter is at low pressure. The floor of the drain tray assembly preferably slopes along its length, the tray having a drain outlet located at the lower end of the drain tray assembly and the barrier tapering in height along its length. The barrier may be formed of sheet stainless steel. The heat exchange unit may include a pipe along which a heat exchange fluid is supplied and a stack of vertical, parallel plates spaced from one another so that air can flow between them laterally of the exchange unit and so that condensate can flow down them to the drain tray assembly. The width of the barrier is preferably substantially equal to the width of the plates.

According to another aspect of the present invention there is provided a drain tray assembly for a fancoil assembly according to the above one aspect of the invention.

According to a further aspect of the present invention there is provided a gutter for a drain tray assembly according to the other aspect of the present invention.

A fancoil assembly with a drain tray assembly according to the present invention, will now be described, by way of example, with reference to the accompanying drawings.

DETAILED DESCRIPTION OF THE PREFERRED EMBODIMENT

Figure 1:
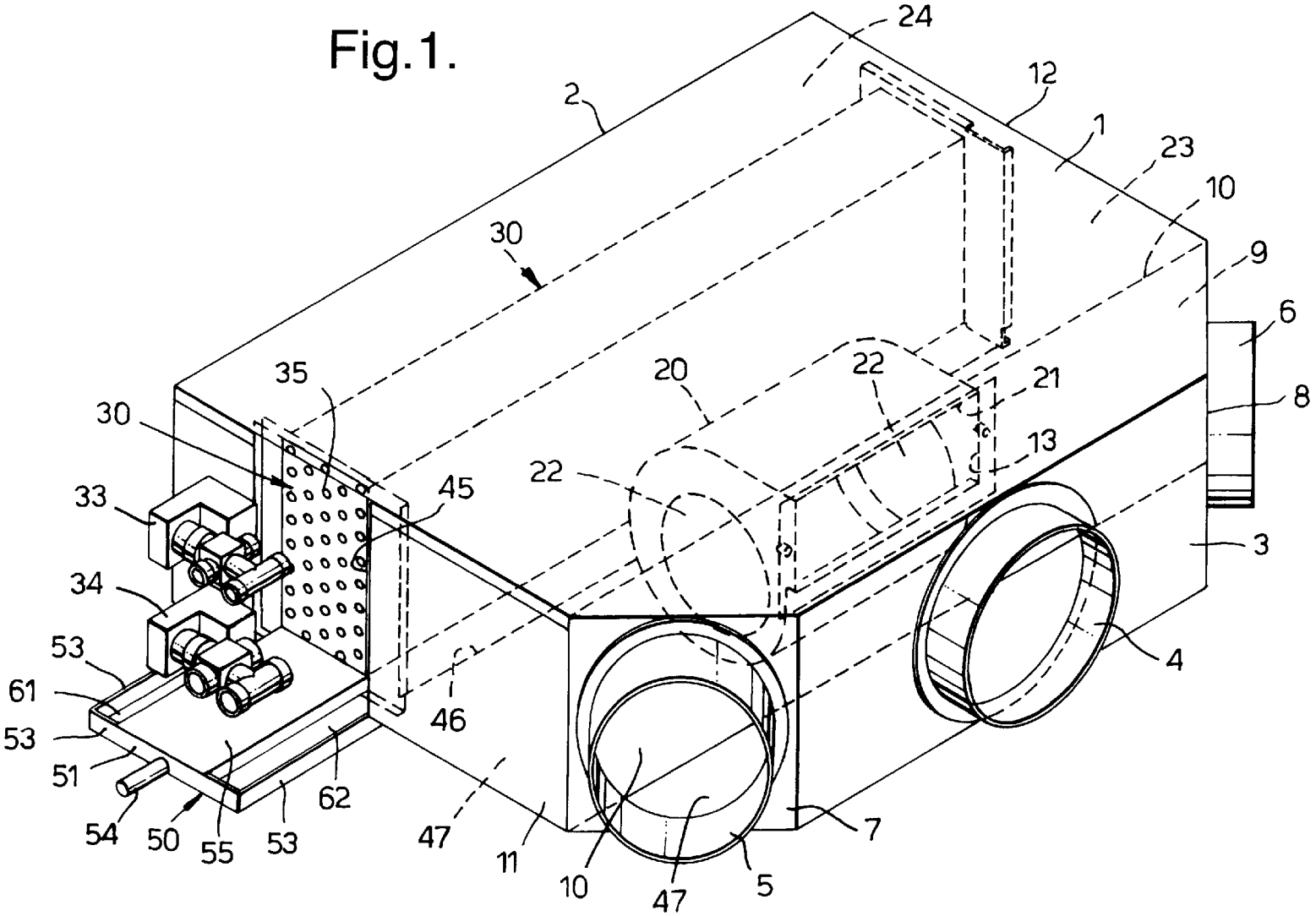
FIG. 1 is a perspective view of the fancoil assembly.

The fancoil assembly comprises a generally rectangular outer casing 1 of sheet metal. One side 2 of the casing 1 is open to the atmosphere and provided with an inlet filter (not shown). The opposite side 3 has a central outlet port 4 and two further outlet ports 5 and 6 on respective angled faces 7 and 8 adjoining the side face 3. The outlet ports 4, 5 and 6 open into a manifold chamber 9 formed by an internal partition wall 10 extending along the length of the casing 1 between opposite end walls 11 and 12 at locations where the end walls adjoin the angled faces 7 and 8. The partition wall 10 has a central rectangular opening 13.

A centrifugal fan or blower 20 is attached to the partition wall 10 outside the manifold chamber 9, with its outlet 21 aligned with the opening 13. Two inlets 22 at opposite ends of the blower 20 open into a downstream chamber 23 located on the downstream airflow side of a heat exchange unit 30, which extends along the length of the casing 1. The heat exchange unit 30 divides the downstream chamber 23 from an upstream chamber 24, which is located on the opposite side of the exchange unit and which opens to atmosphere through the open side 2 to provide an inlet.

Figure 6:
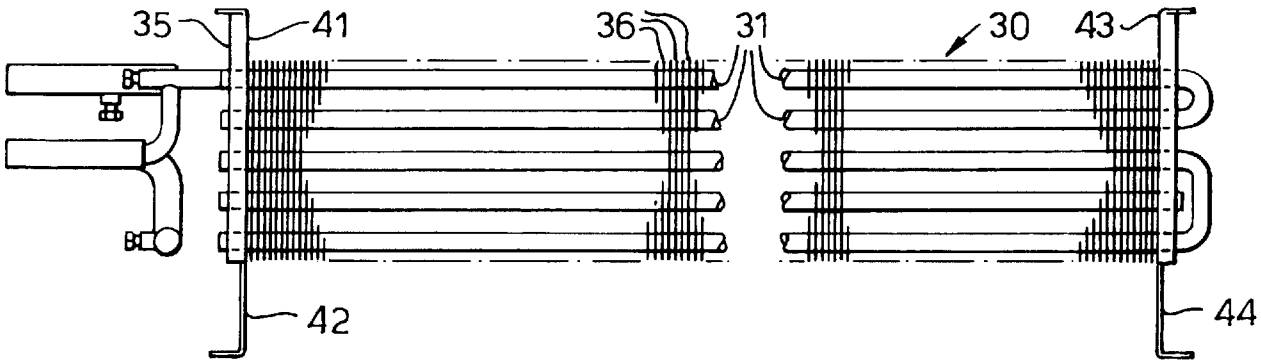
FIG. 6 is a detailed plan view of the heat exchange unit.
Figure 7:
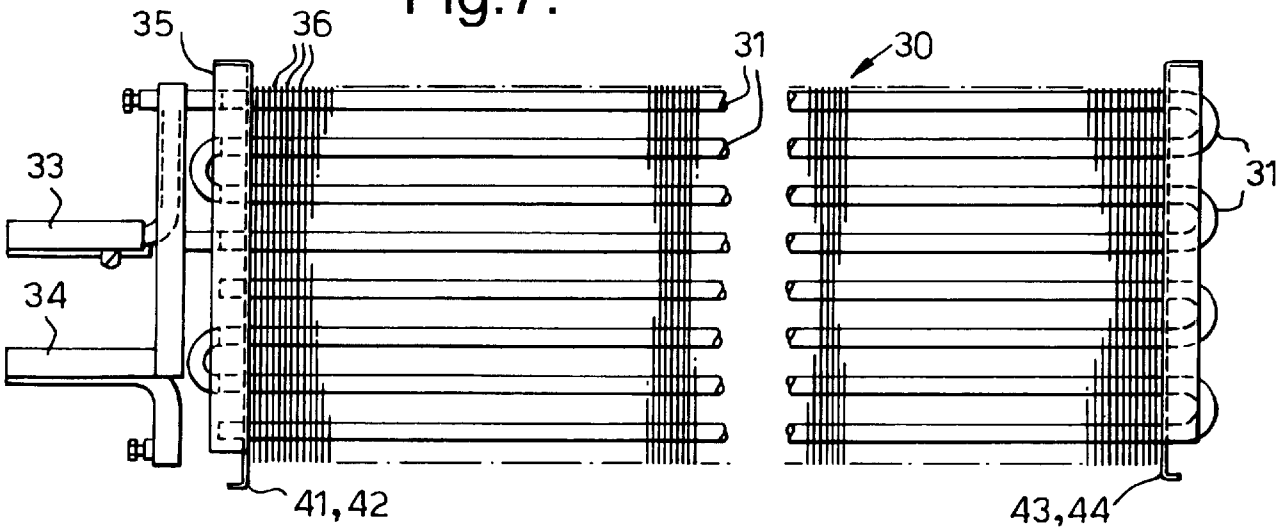
FIG. 7 is a detailed elevation view of the heat exchange unit.

The heat exchange unit 30 is of rectangular shape and section, being about 75 cm long, 22 cm high and 18 cm wide. The exchange unit 30 has a copper pipe 31 (FIGS. 6 and 7) extending along the length of the unit and wound backwards and forward in boustrophedon fashion. Two valve assemblies 33 and 34 are connected to the pipe 31 at the header end 35 of the heat exchange unit 30, one for the connection of hot water and the other for the connection of cold water. The pipe 31 extends through a stack of vertical, parallel metal plates 36, which are closely spaced from one another and act as fins to conduct heat to or from the pipes whilst allowing air to flow laterally through the heat exchange unit 30. The pipe 31 is omitted from FIG. 1 for clarity, the precise disposition of the pipe and plates 36 of the heat exchange unit 30 not being important to an understanding of the present invention. At opposite ends of the heat exchange unit 30, two end plates 37 and 38, both of which have two vertical support legs 41, 42, 43 and 44, project on opposite sides beyond the stack of plates 36 and project down below the plates by a short distance. The pair of legs 41 and 42 at the header end 35 of the exchange unit 30 extends further below the exchange unit than at the opposite end for reasons that will become apparent later. The pipe 31 and valves 33 and 34 at the header end 35 of the exchange unit 30 emerge from the casing 1 through a rectangular aperture 45 in the wall 11, the other end of the exchange unit being enclosed within the casing. The casing 1 also has an aperture 46 in its floor 47 extending the length of the casing beneath the heat exchange unit 30 so as to enable condensation formed on the heat exchange unit drip out of the casing. As so far described, the fancoil assembly is substantially conventional.

Figures 2, 3, 4, 5:
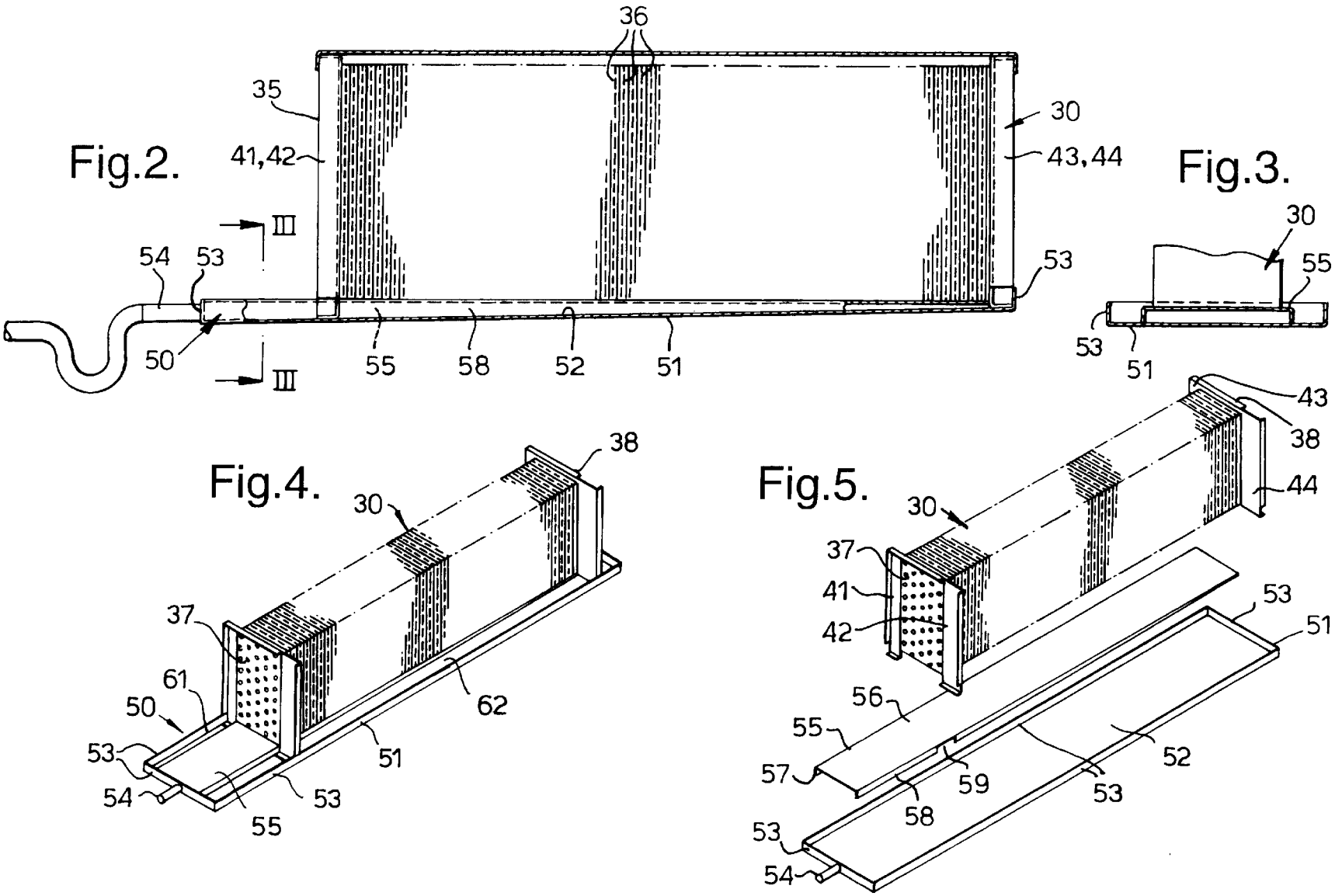
FIG. 2 is a simplified side elevation view of the heat exchange unit and drain tray assembly.
FIG. 3 is a simplified transverse sectional view of the lower part of the heat exchange unit and drain tray assembly along the line III—III in FIG. 2.
FIG. 4 is a perspective view of the heat exchange unit and drain tray assembly.
FIG. 5 is an exploded perspective view of the heat exchange unit and drain tray assembly.

The fancoil assembly also includes a drain tray assembly 50 of novel construction attached to the underside of the floor 47 of the casing I beneath the heat exchange unit 30 and the aperture 46. The drain tray assembly 50 projects beyond the casing 1 at its header end so that it also projects beneath the valve assemblies 33 and 34 to catch any drips or discharge from these. The drain tray assembly 50 comprises two components. One component is a stainless steel tray 51 similar to those used in conventional fancoil assemblies, the tray having a floor 52 and a shallow peripheral wall 53 extending around its edge. The width of the tray 51 is sufficient to accommodate the legs 41 to 44 of the heat exchange unit 30, which sit on the floor 52 of the tray. The casing 1 and heat exchange unit 30 are mounted horizontally and the different length of the legs at the header and rear end of the exchange unit cause the tray 51 to slope down to the front or header end. The wall 53 at the header of the tray 51 has a drain outlet midway across its width in the form of a short conduit 54. The other component of the drain tray assembly is a barrier provided by an inverted gutter 55 of wedge shape in elevation (as most clearly seen in FIG. 5) formed by a sheet of stainless steel having a flat roof 56 and two downwardly-extending walls 57 and 58, which taper, reducing in height from the header end to the opposite end. The wall 58 on the downstream or air-leaving side of the gutter 55 has an opening in the form of a notch 59 cut in it towards the header end. The length of the inverted gutter 55 is the same as that of the tray 50 but its width is less, being equal to the width of the main part of the heat exchange unit 30, defined by the stack of plates 36, such that the gutter 55 can extend under the heat exchange unit between its legs 41 to 44. The gutter 55 is a separate component sitting loosely on the floor 52 of the tray 50 and fills the gap between the top of the tray and the underside of the heat exchange unit 30. It can be seen that the inverted gutter 55 and the tray 50 together define a box-shape section located beneath the heat exchange unit 30 and extending beyond it at the header end 35. The drain outlet 54 opens beneath the inverted gutter 55 into this box-shape section.

The fan 20 sucks air from the inlet side 2 and this flows laterally through the heat exchange unit 30 between the plates 36. The upper surface of the heat exchange unit 30 abuts the roof of the casing 1 so that air cannot flow above the heat exchange unit. The inverted gutter 55 in the drain tray assembly 50 fills the gap between the tray 51 and the underside of the heat exchange unit 30, so that air cannot flow under the heat exchange unit. In this way, a maximum proportion of air flowing through the casing 1 flows between the plates 36 of the heat exchange unit 30. When the fancoil assembly is used for cooling, the cold water valve 34 is opened and the hot water valve 35 is closed so that cold water is pumped through the pipe 31 extracting heat from the plates 36, and hence from the air flowing over the plates. Moisture in the air condenses as water on the pipe 31 and on the plates 36 and flows down under gravity to the lower part of the heat exchange unit. The water then flows over the upper surface of the gutter 55 and down its sides 57 and 58 into two channels 61 and 62 formed between opposite sides of the gutter and the side walls 53 of the tray 51. The slope of the tray 51 allows collected water to flow forwardly to the header end 35 of the drain tray assembly 50. Water is free to flow under the walls 57 and 58 of the gutter 55 into the box-shape section so that water can then discharge through the conduit 54. The notch 59 in the wall 58 ensures that the void within the box section is at fan suction/low pressure so that condensate can flow freely into this void.

The invention enables existing drain tray assemblies to be readily modified by the inclusion of an inverted gutter or the like. It will be appreciated that the box section could be provided in other ways than by a removable gutter and that it could be provided by a component secured to the drain tray. The walls down the side of the gutter help block air flow under the heat exchange unit but this could be achieved by a single wall if desired.

By preventing or substantially reducing air flow under the heat exchange unit, the gutter helps maximize the efficiency of the fancoil assembly because the maximum proportion of air will flow through the exchange unit itself. In this way, the reduced amount of bypass or untreated air mixing with the treated air at the outlet helps minimize the de-rating effect. The unit of the present invention also helps prevent any high velocity region below the exchange unit where air could blow condensate out of the drain tray. Also, by preventing air flow beneath the heat exchange unit, condensate can flow freely under gravity down the plates into the drain tray.

What I claim is:

1. A fancoil assembly comprising:

a heat exchange unit;

a fan arranged to cause flow of air through the heat exchange unit; and a drain tray assembly below the heat exchange unit to collect liquid from the heat exchange unit, said drain tray assembly including a tray with a peripheral wall, said tray having an upper surface spaced from a lower surface of said heat exchange unit, wherein said drain tray assembly includes a barrier having at least one wall generally opposed to the direction of flow of air through said fancoil assembly and spanning a space between the upper surface of said tray and the lower surface of said heat exchange unit such as to restrict flow of air through the space under the heat exchange unit, and wherein said barrier is an inverted gutter having a roof and two walls extending along opposite sides and is arranged such that liquid flowing from said heat exchange unit can drain freely into said tray.

2. A fancoil assembly according to claim 1, wherein the said two walls of said gutter are spaced from opposite sides of said tray to form two channels.

3. A fancoil assembly according to claim 1, wherein said gutter is loose within said tray.

4. A fancoil assembly according to claim 1, wherein a wall of said gutter on a low pressure side of the assembly has an opening so that a void within said gutter is at low pressure.

5. A fancoil assembly according to claim 1, wherein a floor of said drain tray assembly slopes along its length, wherein said tray has a drain outlet located at a lower end of said drain tray assembly, and wherein said barrier tapers along its length.

6. A fancoil assembly according to claim 1, wherein said barrier is formed from sheet stainless steel.

7. A fancoil assembly according to claim 1, wherein said heat exchange unit includes a pipe along which a heat exchange fluid is supplied and a stack of vertical, parallel plates spaced from one another so that air can flow between them laterally of said exchange unit and so that liquid condensate can flow down the plates to said drain tray assembly.

8. A fancoil assembly according to claim 7, wherein said barrier has a width substantially equal to a width of said plates.

9. A fancoil assembly comprising: a heat exchange unit comprising a pipe along which a heat exchange fluid is supplied and a stack of vertical parallel plates spaced from one another; a fan arranged to cause flow of air through the heat exchange unit between said plates; and a drain tray assembly below the heat exchange unit to collect liquid from the heat exchange unit, said drain tray assembly including a tray with a peripheral wall and a drain outlet, and said tray having an upper surface spaced from a lower surface of said heat exchange unit, wherein said drain tray assembly includes an inverted gutter having a roof extending across an underside of said plates and having opposite side walls generally opposed to flow of air under the heat exchange unit such as to restrict flow of air between the drain tray assembly and the underside of the heat exchange unit, and wherein the said side walls of said gutter are spaced from side walls of said tray such that liquid flowing from said heat exchange unit can drain freely into said tray and to said drain outlet.

10. A drain tray assembly for location below a heat exchanger to collect liquid from the heat exchanger, wherein the assembly comprises:

a tray having a peripheral wall and a drain outlet, the width of said tray being sufficient to extend across the width of the heat exchanger; and a barrier located between opposite sides of said tray, said barrier projecting from a floor of said tray to a height adjacent an underside of said heat exchanger such that said barrier substantially blocks the flow of air across the width of said tray assembly beneath said heat exchanger, wherein said barrier is an inverted gutter having a roof and two sides and said two sides are spaced from sides of said tray so that liquid from the heat exchanger can flow over the roof of the gutter and down said barrier sides into said tray.

* * * * *